United States Patent [19]

Brand

[11] 4,130,611

[45] Dec. 19, 1978

[54] ATTEMPERATOR

[75] Inventor: Warren H. Brand, Blue Bell, Pa.

[73] Assignee: Yarway Corporation, Blue Bell, Pa.

[21] Appl. No.: 748,117

[22] Filed: Dec. 6, 1976

[51] Int. Cl.[2] ..... B01F 3/04

[52] U.S. Cl. ..... 261/66; 122/487; 137/625.3; 137/625.38; 239/563; 251/210; 261/115; 261/116; 261/118; 261/DIG. 13

[58] Field of Search ..... 261/115, 116, 118, 66, 261/76, DIG. 10, DIG. 13, DIG. 32, DIG. 33, DIG. 76, 62; 122/487; 239/491, 563, 555; 137/625.3, 625.37, 625.38, 625.39, 605; 251/210

[56] References Cited

U.S. PATENT DOCUMENTS

| | | | |
|---|---|---|---|
| 43,598 | 7/1864 | Noyes | 137/625.38 |
| 538,993 | 5/1895 | Winkler | 239/563 X |
| 1,062,614 | 5/1913 | Sneddon | 137/605 |
| 1,800,243 | 4/1931 | Birks et al. | 251/210 |
| 1,884,931 | 10/1932 | Voorheis | 239/491 |
| 2,102,504 | 12/1937 | Beardsley, Jr. et al. | 261/39 A |
| 2,155,986 | 4/1939 | Wheaton | 261/DIG. 13 |
| 2,222,348 | 11/1940 | Gorrie | 261/DIG. 13 |
| 2,687,614 | 8/1954 | Goddard | 261/118 X |
| 3,092,677 | 6/1963 | Spence | 261/DIG. 13 |
| 3,220,710 | 11/1965 | Forster | 261/DIG. 13 |
| 3,287,001 | 11/1966 | Harris | 261/DIG. 13 |
| 3,331,590 | 7/1967 | Battenfeld et al. | 261/DIG. 13 |
| 3,732,851 | 5/1973 | Self | 122/487 |
| 3,819,321 | 6/1974 | Witt | 239/555 X |
| 3,894,716 | 7/1975 | Barb | 137/625.3 X |
| 3,990,475 | 11/1976 | Myers | 137/625.3 |
| 4,011,287 | 3/1977 | Marley | 261/DIG. 13 |
| 4,036,248 | 7/1977 | Yoshimori et al. | 137/625.3 X |

FOREIGN PATENT DOCUMENTS

| | | | |
|---|---|---|---|
| 124356 | 9/1931 | Australia | 261/115 |
| 11540 | 6/1908 | United Kingdom | 239/563 |

*Primary Examiner*—Richard L. Chiesa
*Attorney, Agent, or Firm*—Ferrill and Logan

[57] ABSTRACT

An attemperator in the form of a steam desuperheater is disclosed herein and comprises a water tube adapted to be connected to a source of water under high pressure and a spray tube communicating with the water tube through a flow-control device for controlling the flow of water from the water tube to the spray tube. The spray tube is adapted to be located in a steam line for injecting cooling water into the steam when its temperature exceeds a predetermined temperature and accordingly is formed with one or more nozzles for injecting a spray of water travelling along an expanding swirling path into the steam, the water being atomized into small droplets which easily evaporate in the steam. Preferably, a plurality of nozzles are provided arranged in rows extending axially of the spray tube and the rows are circumferentially spaced apart. Also, the nozzles preferably communicate with the inside of the spray tube through a series of small ports. A piston movable axially within the spray tube controls the quantity of water discharged into the steam.

10 Claims, 4 Drawing Figures

ATTEMPERATOR

This invention relates to attemperators for spraying one fluid into another fluid to obtain or maintain a specific characteristic in the other fluid. A common form of attemperator is a desuperheater by which cooling fluid is sprayed into a flow of steam to reduce the temperature a degree of superheat of the steam.

Systems utilizing steam as a source of energy are designed to operate with the steam at a particular temperature and pressure. Usually the steam being fed from the steam boiler is superheated so that it is possible that the device which utilizes the energy of the steam can receive steam at a higher temperature than that required. To maintain the desired temperature conditions, it is usual to cool the superheated steam to a lower temperature by utilizing a desuperheater inserted into the steam line which injects cooling water into the steam.

In order to effectively control the temperature of the steam, several requirements are imposed on the operation of steam desuperheaters which requirements must be concurrently satisfied. One of the more important requirements imposed on steam desuperheaters is the requirement that the amount of cooling water supplied to the steam line be precisely controlled. Obviously, too much or too little cooling water will not accurately maintain the temperature of the steam. Another important requirement is the requirement that the cooling water be injected into the steam line in a form which facilitates its evaporation in the steam. If the cooling water does not evaporate quickly it will collect at the bottom of the steam line and evaporate in a more or less uncontrolled manner which makes precise control of the steam temperature almost impossible. Another important requirement is the requirement that the cooling water be distributed in the steam line in a generally uniform pattern so that the temperature of the steam is reduced uniformly throughout.

Accordingly, it is an object of this invention to provide an attemperator or steam desuperheater constructed and arranged to provide for relatively precise control over the amount of cooling water injected into a steam line.

It is another object of this invention to provide an attemperator or steam desuperheater constructed and arranged to inject the cooling water into the steam line in the form of small droplets which can easily evaporate in the steam.

It is still another object of this invention to provide a steam desuperheater constructed and arranged to provide a generally uniform distribution of the cooling water in the steam.

Finally, it is another object of this invention to provide a steam desuperheater that provides for the precise control of the amount of cooling water injected into the steam, that injects the cooling water into the steam in a form which allows for easy evaporation, that distributes the cooling water in a generally uniform manner throughout and which is relatively simple, rugged and economical.

These and other objects of this invention are accomplished by providing a steam desuperheater comprising a water tube adapted to be connected to a source of cooling water under high pressure and a spray tube adapted to be inserted into a steam line. Flow-control means is provided between the water tube and the spray tube for controlling the flow of cooling water from the former to the latter. Formed through the wall of the spray tube are a plurality of nozzle means for injecting a spray of cooling water travelling along an expanding swirling path from the spray tube into the steam line. Because of the high pressure differential between the cooling water and the steam, the spray of water is atomized into small droplets which easily evaporate in the steam and reduce its temperature.

Preferably, the nozzle means are axially spaced apart along the spray tube and the flow-control means includes a plug member slidably received in the spray tube and in sealing engagement therewith such that movement of the plug member axially in the spray tube sequentially uncovers and opens the nozzle means whereby the amount of fluid injected from the spray tube into the steam line can be controlled. Also, a plurality of small ports communicate between the interior of the spray tube and a particular nozzle means such that as the plug member moves axially, the number of ports allowing the passage of cooling water from the spray tube to the particular nozzle means is also controlled to regulate the amount of water distributed through each nozzle.

It has also been found preferable to arrange the nozzle means in a plurality of spaced apart axially extending rows. By selecting suitable circumferential spacing the distribution of the cooling water in the steam can be accomplished in a more uniform manner.

The preferred nozzle means for injecting the fluid into the steam line includes a vortex chamber associated with generally tangentially arranged inlet passages whereby the fluid is imparted with a whirling motion as it enters the vortex chamber. Adjacent the vortex chamber there is provided a conical nozzle means which imparts a conical shape to the whirling fluid as it is injected into the steam.

For a better understanding of the invention, reference is made to the following description of a preferred embodiment thereof with reference to the figures of the accompanying drawing in which.

Figure 1:
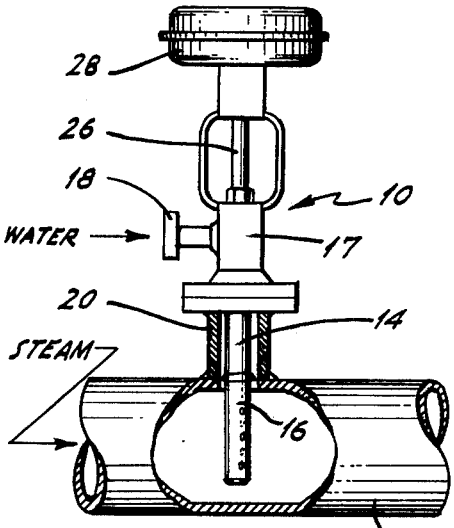
FIG. 1 is a side view of a steam desuperheater in accordance with this invention inserted in a steam line portions of which are broken away for the sake of clarity.

Referring now particularly to FIG. 1 of the drawing, there is illustrated one form of an attemperator 10 constructed in accordance with this invention and inserted in a steam line 12 for injecting cooling water into the steam line when it contains superheated steam or when it is otherwise desirable to cool the steam. The attemperator, or desuperheater as shown in this embodiment, includes a water tube 14 and a spray tube 16 coaxial with and in communication with the water tube. Attached to the water tube 14 is a water chamber 17 including a generally conventional flanged coupling 18 for connecting the water tube to a source of cooling water under high pressure. Extending from the water chamber 17 concentrically around the water tube 14 is a collar member 20 that terminates adjacent the spray tube 16 and which is utilized for coupling the attemperator to the steam line 12. Any of a variety of coupling members can be utilized, and in this embodiment the collar member 20 is illustrated as welded to the steam line about a generally circular opening formed in the wall of the steam line through which the spray tube 16 extends.

Figure 2:
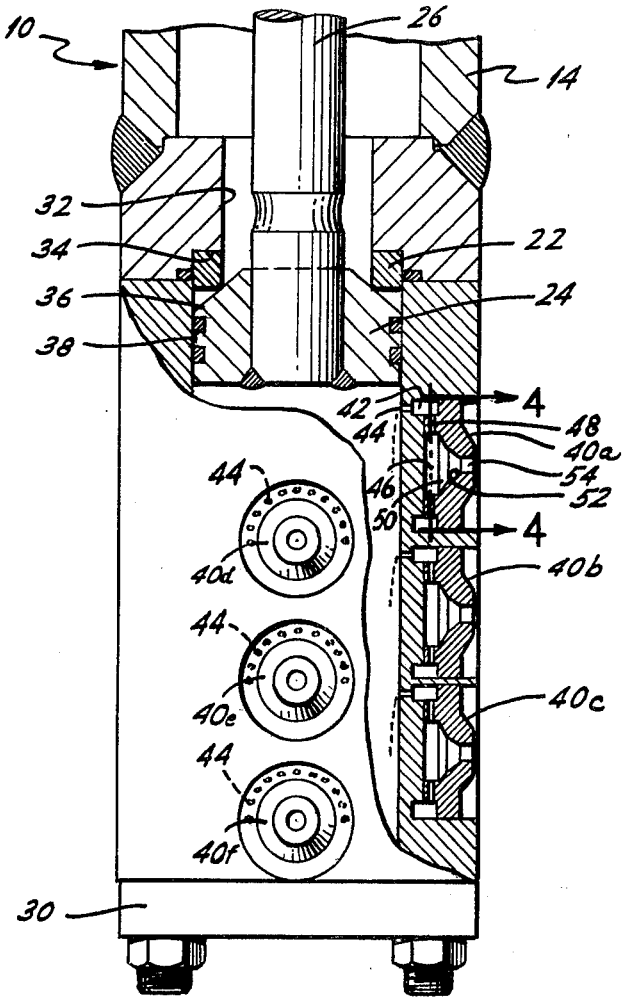
FIG. 2 is a partial sectional view of a portion of the steam desuperheater illustrated in FIG. 1.

Referring briefly to FIG. 2 of the drawing, a flow control means is illustrated for allowing or preventing flow of the cooling water from the water tube 14 to the spray tube 16 and for regulating the flow from the spray tube to the steam line 12. The flow control means includes a valve seat 22 and a plug member 24 connected to an operating rod member 26. Now referring back to FIG. 1, a control mechanism (not illustrated) is located in a housing 28 for operating the rod member 26 and controlling the flow control means. The control mechanism can be any suitable type generally conventional in the art and is not described in detail. However, it should be noted that conventional control mechanisms generally include a temperature sensing probe inserted in the steam line 12 downstream of the attemperator 10 which senses the temperature of the steam. This temperature measurement is used to determine the amount, if any, of cooling water that must be injected into the steam to maintain the desired temperature. In response to this determination the control mechanism operates the operating rod member 26.

Figure 4:
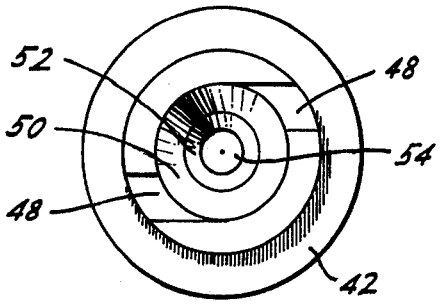
Figure 3:
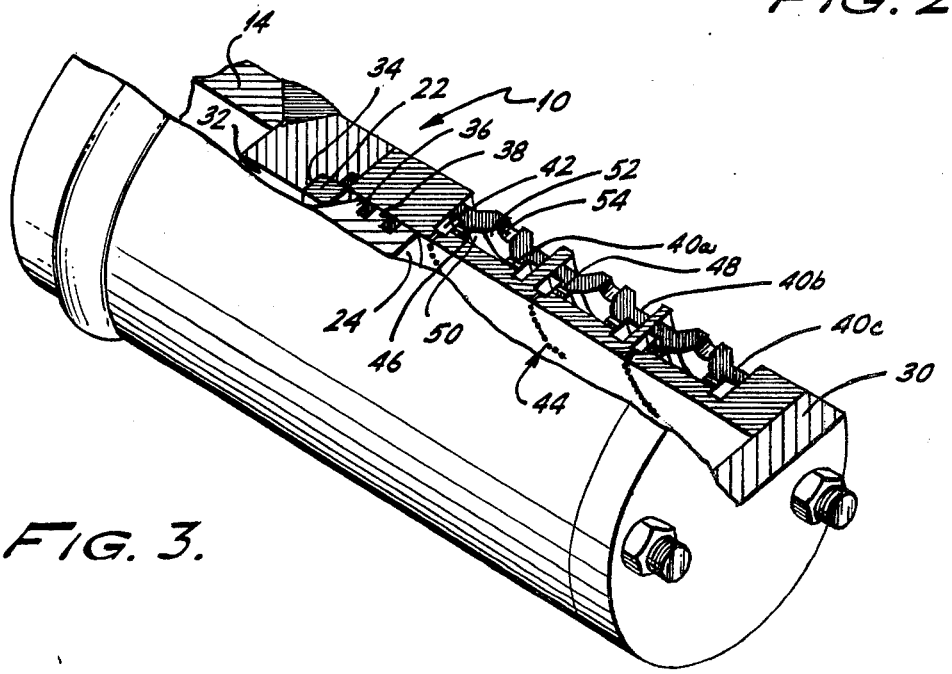
FIG. 3 is a perspective view partially in section of the same portion of the steam desuperheater illustrated in FIG. 2; and, FIG. 4 is a sectional view taken along line 4—4 of FIG. 2.

Referring now to FIGS. 2 and 4 of the drawing, it can be seen that the water tube 14 and the spray tube 16 are axially aligned hollow cylindrical members secured together as by welding and in communication at their adjacent ends. The opposite end of the water tube 14 communicates with the water chamber 17 and the opposite end of the spray tube 16 is closed by an end wall 30. At the end of the spray tube 16 there is a reduced diameter portion forming a flow passage 32 and a shoulder 34 on which the valve seat 22 is carried. The plug member 24 includes a conical surface 36 and a cylindrical surface portion 38 slidably received in the spray tube 16 and in sealing engagement with its interior wall. Movement of the operating rod member 26 moves the plug member between one position wherein the conical surface portion 36 bears on the valve seat 22 to prevent the flow of cooling water into the spray tube 16 and other positions wherein the plug member is spaced from the valve seat to allow the flow of cooling water into the spray tube.

Carried in the spray tube is a nozzle arrangement for discharging cooling water from the spray tube into the steam line. As will be explained hereinafter, the nozzle arrangement includes a plurality of nozzle means **40*a*, 40*b*, 40*c*, 40*d*, 40*e* and 40*f*** each of which injects the cooling water as a swirling spray travelling along an expanding helical path into the steam line. Because of the relatively large pressure differential between the water which is at a relatively high pressure and the steam which is at a significantly lower pressure, the swirling spray of water breaks up or atomizes into tiny droplets which easily evaporate in the steam. The expanding conical flowpath provides for a more uniform distribution of the water droplets in the steam.

The nozzle means are arranged in a plurality, preferably two, rows each of which extend axially along the spray tube 16 and each of which include a plurality of nozzle means. As illustrated in the drawing, one row includes nozzle means **40*a*, 40*b*, and 40*c* and the other row includes nozzle means 40*d*, 40*e* and 40*f***. Preferably, all of the nozzle means in each row are axially aligned and the two rows are spaced apart circumferentially to provide a more uniform distribution of the water in the steam. In the preferred embodiment disclosed herein, the spacing between each row is approximately 90°, but it should be understood that any suitable spacing can be utilized. Thus, the rows may be closer together or farther apart, but preferably should be no farther apart than 180°.

As best seen in FIG. 2 of the drawing, the nozzle means in one row are offset in the axial direction from the nozzle means in the other row, that is, a transverse plane through the center of any nozzle means will not include the center of another nozzle means. Preferably, the offset is such that the center of a nozzle means in one row is located at about the midpoint between adjacent nozzle means in the other row. For example, the center of nozzle means **40*d* is located at the midpoint of the axial distance between nozzle means 40*a* and 40*b*, but circumferentially spaced therefrom. With this arrangement, it is possible to control the amount of water fed to the steam line. Since the cylindrical surface portion 38 of the plug is in sealing engagement with the interior wall of the spray tube 16, it should be clear that as the plug member 24 is moved from the seat 22 toward the end wall 30, it uncovers the nozzle means sequentially in the following order: 40*a*, 40*d*, 40*b*, 40*e*, 40*c* and 40*f*. As each nozzle means is uncovered cooling water can flow from the interior of the spray tube 16 through the uncovered nozzle or nozzles into the steam line. Accordingly, by controlling the position of the plug member 24 the number of open nozzle means and consequently the amount of cooling water injected into the steam line 12** can be controlled.

Each of the nozzle means is operative to discharge the cooling water as a swirling spray travelling along an expanding helical path. Since the nozzle means are all the same, only one will be particularly described and, for the sake of clarity on the drawing, reference numerals will be applied only to the nozzle means **40*a*. Each nozzle means includes an annular chamber 42 that communicates through a plurality of small ports 44 with the interior of the spray tube 16. The ports 44 are spaced apart throughout generally one-half of circumferential extent of the annular chamber 42 with ports 44 of the nozzle 40*a*, *b* and *c* being in the upper half of the chamber and the ports in chambers 40*d*, *e* and *f* also being in the upper half of the chamber. As the plug member 24 moves axially along the spray tube 16, the cylindrical portion 38 can uncover one or any combination up to all of the ports 44 associated with each nozzle means to regulate the amount of cooling water supplied to each nozzle means. The ports 44 can thus be said to open sequentially. Each annular flow chamber 42 communicates with a generally cylindrical vortex chamber 46 through a pair of passages 48, 48. As best seen in FIG. 4, the passages 48, 48 are arranged tangentially with respect to the vortex chamber 46 so that as the fluid is discharged from the annular flow chamber 42 to the vortex chamber 46, it is imparted with a swirling motion. Communicating with the vortex chamber 46 are first and second conical surfaces 50 and 52 which provide a conical shape to the swirling water which is then discharged through a generally cylindrical port 54 and begins to expand as it is discharged to provide the expanding conical shape. The thickness of the cylindrical port 54 is exaggerated in the drawing, it being realized that the thickness should be as small as possible, but that due to the relatively high pressure of the cooling water, must have some appreciable thickness to withstand the pressure forces. While two conical surfaces 50 and 52** are disclosed it should be understood that only one need be provided, but the use of two is preferred to facilitate shaping the water flow into a conical shape having a relatively small included angle.

In use the attemperator is mounted to the steam line 12 through the mounting collar 20 such that the spray tube 16 extends into the steam line with the nozzle means 40*a*, 40*b*, 40*c*, 40*d*, 40*e* and 40*f* facing the generally downstream direction of the steam line. The spray tube 16 can be inserted through a slightly oversized opening in the steam line 12 and the mounting collar 20 can be welded in place around the opening to prevent the escape of steam. A source of water under extremely high pressure is attached to the flange coupling 18 so that the water flows through the water chamber 17 into the water tube 14. Temperature sensing probes associated with the control mechanism are inserted into the steam line 12 downstream of the attemperator 10 a sufficient distance to allow for cooling water to be evaporated and lower the temperature of the steam. Thus, the temperature sensing probes read the temperature of the cooled steam to more accurately control the amount of water being injected into the steam line.

With conical surface portion 36 of the plug member 24 bearing on valve seat 22, there is no flow of cooling water from the water tube 14 and the spray tube 16. When the temperature of the steam increases above the desired temperature, the control mechanism operates the rod member 26 moving it and the plug member 24 toward the end wall 30. As the plug member 24 moves the conical surface portion 36 no longer bears on the valve seat 22 allowing the cooling water to flow into the spray tube 16. As the plug member 24 continues to move the circular surface portion 38 eventually uncovers some of the ports 44 associated with the nozzle means 40*a*. At this point cooling water flows through the uncovered port 44 to the annular chamber 42, through the tangential ports 48 into the vortex chamber 46 and then through the conical portions 50 and 52. From the conical portions 50 and 52 the cooling water is discharged through the cylindrical port 54 as a swirling spray travelling along an expanding helical path. As noted previously the water breaks up into tiny droplets after it is discharged which droplets easily evaporate in the steam. If more cooling water is required, the plug member 24 is moved farther away from the valve seat 22 until all of the ports 44 associated with nozzle means 40*a* are uncovered and if still more cooling water is required is moved opening ports 44 associated with nozzle means 44*d*, then 44*b*, then 44*e*, then 44*c* and finally 44*f*. Movement of the plug member 24 can be stopped at any point between valve seat 22 and end wall 30 when the proper amount of cooling water is being discharged to maintain the desired temperature of the steam in the steam line 12. Obviously if the temperature of the steam in steam line 12 decreases to a temperature where less or no cooling water is required, the plug member 24 is moved back toward the valve seat decreasing the amount of water discharged into the steam line and if necessary can stop the flow of cooling water into the spray tube 16.

From the preceding it should be clear that an attemperator has been provided that can control the amount of cooling water discharged through any nozzle means and can control the total amount of cooling water discharged into the steam line and that the water is discharged through the nozzle means in a form that easily evaporates in the steam. In addition, because of the arrangement of the nozzle means in a plurality of rows, cooling water can be uniformly discharged into the steam.

While in the foregoing, a preferred embodiment of the invention has been described it should be obvious to one skilled in the art that various changes and modifications can be made without departing from the true spirit and scope of the invention as recited in the appended claims.

I claim:

1. An attemperator for spraying a liquid into a gaseous stream, said attemperator comprising a spray tube, means for connecting said spray tube to a high pressure source of liquid, valve means at the entrance to said spray tube for allowing or preventing the flow of liquid into said spray tube, a plurality of nozzle means on said spray tube injecting a fine spray of liquid droplets travelling along an expanding helical path from each nozzle means into the gaseous stream, a plurality of small ports formed in said spray tube with some of said ports being spaced about each nozzle means, each of said small ports communicating between the interior of said spray tube and said nozzle means and each one of said small ports being axially spaced from the other of said small ports, said valve means including a plug member slidably received in sealing engagement with the interior of said spray tube whereby said plug member opens said ports sequentially and controls the flow of liquid of each of said nozzle means.

2. An attemperator in accordance with claim 1 wherein said nozzle means are arranged in a plurality of rows extending axially along said spray tube, said rows being circumferentially spaced apart and each nozzle means in a row being offset in the axial direction from the nozzle means in an adjacent row so that a liquid can be discharged through a nozzle means in one row and then a nozzle means in another row.

3. An attemperator in accordance with claim 2 wherein the center of any nozzle means in one row is located at approximately the midpoint between adjacent nozzle means in an adjacent row.

4. An attemperator in accordance with claim 1 wherein each said nozzle means includes a vortex chamber and generally tangential inlet ports whereby the liquid is imparted with a whirling motion as it enters said vortex chamber.

5. An attemperator in accordance with claim 4 wherein an annular chamber communicates with said tangential inlet ports and wherein said ports communicate with said annular chamber for providing communication between said spray tube and said annular chamber.

6. An attemperator in accordance with claim 5 wherein each said nozzle means further includes a conical portion communicating with said vortex chamber for imparting a conical shape to the whirling liquid.

7. An attemperator in accordance with claim 6 wherein said relatively small ports are spaced in sequence so that the opening of the first port in the following nozzle will occur after the opening of the last port in the preceding nozzle.

8. An attemperator in accordance with claim 1 wherein said ports extend around a portion of each of the periphery of said nozzles located closest to said entrance to said spray tube whereby all of the ports around a nozzle are opened before any ports around the following nozzle are opened.

9. An attemperator in accordance with claim 1 wherein the ports spaced about any nozzle means extend around only the upper half thereof.

10. An attemperator for introducing a liquid into a gaseous stream passing through a pipeline comprising a liquid tube, means for connecting said liquid tube to a high pressure source of liquid, a spray tube in communication with said liquid tube, mounting means for coupling said device to the pipeline so that said spray tube extends into said gaseous stream, flow control means between said liquid tube and said spray tube, said flow control means including a seat member and a plug member cooperating with said seat to allow or prevent the flow of liquid from said liquid tube to said spray tube, a plurality of nozzle means on said spray tube, said nozzle means being arranged in a plurality of rows each extending axially along said spray tube and being circumferentially spaced apart by an angle no greater than 180°, the nozzle means in one row being offset in the axial direction from the nozzle means in adjacent row, each said nozzle means including an annular chamber communicating with said spray tube through a plurality of relatively small ports, a vortex chamber, and at least one tangential port communicating between said annular chamber and said vortex chamber tangentially arranged with respect to said vortex chamber whereby liquid discharged from said annular chamber to said vortex chamber is imparted with a whirling motion, each said nozzle means further including a conical portion communicating with said vortex chamber for imparting a conical shape to said whirling liquid, and a cylindrical port through which said liquid is discharged into said gaseous stream as a fine spray travelling in an expanding helical path, said plug member being in sliding engagement with the interior of said spray tube whereby said plug member sequentially opens each of said nozzle means and said relatively small ports communicating with said annular chambers.

* * * * *